US006722906B2

(12) United States Patent
Tsing

(10) Patent No.: US 6,722,906 B2
(45) Date of Patent: Apr. 20, 2004

(54) ELECTRICAL CONNECTOR

(75) Inventor: Lu Tsing, U Shyi (TW)

(73) Assignee: Molex Incorporated, Lisle, IL (US)

( * ) Notice: Subject to any disclaimer, the term of this patent is extended or adjusted under 35 U.S.C. 154(b) by 0 days.

(21) Appl. No.: 10/353,338

(22) Filed: Jan. 29, 2003

(65) Prior Publication Data

US 2003/0166354 A1 Sep. 4, 2003

(30) Foreign Application Priority Data

Jan. 29, 2002 (TW) ..... 91200920 U

(51) Int. Cl.[7] ..... H01R 13/62
(52) U.S. Cl. ..... 439/260
(58) Field of Search ..... 439/260, 495, 439/329

(56) References Cited

U.S. PATENT DOCUMENTS 6,267,620 B1 * 7/2001 Ma ..... 439/260
6,431,907 B1 * 8/2002 Ma ..... 439/260
6,517,367 B2 * 2/2003 Yamane ..... 439/260
6,524,124 B2 * 2/2003 Yamane ..... 439/260
6,533,606 B2 * 3/2003 Yamane ..... 439/260

* cited by examiner

*Primary Examiner*—Gary F. Paumen
(74) *Attorney, Agent, or Firm*—Robert J. Zeitler

(57) ABSTRACT

This invention provides an electrical connector which includes an insulated housing, a plurality of conductive terminals, and a cover body. The cover body is moved by a user between a first position, a second position, and a third position relative to the insulated housing so that electrical contacts of an electronic card and contact portions of the conductive terminals are pressed against one another when the cover body is moved from the first position to the second position. When the cover body is moved from the second position to the third position, the electronic card moves simultaneously with the cover body such that the electrical contacts of the electronic card and the contact portions of the conductive terminals contact frictionally each other through a short distance relative movement to wipe out dust or contaminants. This increases the reliability of their electrical connection.

9 Claims, 5 Drawing Sheets

PRIOR ART

ELECTRICAL CONNECTOR

FIELD OF THE INVENTION

The invention relates to an electrical connector, more particularly to an electrical connector for a mobile phone for insertion of an electronic card with chips.

DESCRIPTION OF THE RELATED ART

The digital mobile phone system has almost replaced the analog mobile phone system due to their safety in keeping confidentially information and their superior quality for digitizing transmission signals in transmitting voices or graphics. In order to identify each user in the digital mobile phone system, mobile phones are connected with at least one SIM (Subscriber Identity Module) card. The SIM electronic card includes a chip that stores personal identification number (PIN) data. The chip is formed with a plurality of electrical contacts on a side surface of the electronic card, and a circuit board of the mobile phone must have an electrical connector to connect with the electronic card so that after the electronic card is inserted into the mobile phone, the chip of the electronic card can contact electrically the circuit board of the mobile phone to transmit data.

Referring to FIG. 1, a conventional electrical connector 3 is shown to be connected with an electronic card 4. The connector 3 has an upper contact surface 31 formed with six terminal passages 33, and six conductive terminals 32 received respectively in the terminal passages 33. The conductive terminals 32 have contact portions 321 that project resiliently out of the contact surface 31 of the connector 3 to contact electrically and respectively six electrical contacts 41 of the electronic card 4, and engaging portions that are welded to a circuit board 5 of a mobile phone. During assembly, the electronic card 4 is initially inserted into a receiving unit (not shown). Then, through a pivoting manner, the side surface of the electronic card 4 having the six electrical contacts 41 is pressed against the contact surface 31 of the electrical connector 3 so that the electrical contacts 41 are in direct contact with the contact portions 321 of the conductive terminals 32 so as to establish an electrical connection. However, due to such a directly pressed connection, a relatively small point-to-point contact area can be produced between each contact 41 and the corresponding contact portion 321 of the conductive terminals 32 so that, when the electrical contacts 41 or the contact portions 321 of the conductive terminals 32 are stained with dust or other contaminants, poor electrical contact results. This leads to unstable electrical connection which can cause the mobile phone unable to use due to its inability to accurately read the data stored in the chip of the electronic card 4.

Referring to FIG. 2, in order to prevent the above-mentioned drawback, another conventional electrical connector 3 has been proposed. The electrical connector 3 has two lateral sides provided with guide grooves (not shown) for guiding the electronic card 4 toward the contact surface 31 of the electrical connector 3 so as to be in contact with the contact portions 321 of the conductive terminals 32. Due to horizontal movement of the electronic card 4, the electrical contacts 41 of the electronic card 4 and the contact portions 321 of the conductive terminals 32 are in frictional contact with each other until the electronic card 4 is positioned so that better electrical connection between the electrical contacts 41 and the contact portions 321 of the conductive terminals 32 can be provided and the poor electrical contact problem is avoided. Although the electrical connector 3 has achieved its intended purpose, the frictional contact between the electrical contacts 41 of the electronic card 4 and the contact portions 321 of the conductive terminals 32 occurs along a relatively long distance so that the electrical contacts 41 and the contact portions 321 are susceptible to wearing, especially when the electronic card 4 is frequently taken out for replacement.

OBJECT AND SUMMARY OF THE INVENTION

Therefore, the main object of the present invention is to provide an electrical connector that provides more reliable electrical contact with an electronic card.

According to this invention, an electrical connector comprises an insulated housing, a plurality of conductive terminals, a cover body, a retaining unit, and, optionally, at least one limiting unit. Through the electrical connector of this invention, an electronic card having a plurality of electrical contacts can be electrically connected to a circuit board.

The insulated housing has a contact surface for contact with the electronic card, a connecting surface for connection with the circuit board, and opposite first and second lateral surfaces. The insulated housing further includes a plurality of terminal passages disposed between the contact surface and the connecting surface, and defines a first direction and a second direction that forms an angle with the first direction.

Each of the conductive terminals is received respectively inside the passages, and has a contact portion and an engaging portion. The contact portion projects out of the contact surface of the insulated housing, while the engaging portion projects out of the connecting surface of the insulated housing and connects electrically the circuit board.

The cover body is mounted movably and pivotally on the insulated housing, and cooperates with the contact surface of the insulated housing to define a receiving space for insertion of the electronic card therein.

The retaining unit includes a first element disposed on the insulated housing, and a second element disposed correspondingly on the cover body. The first element and the second element engage movably so that the cover body can pivot relative to the insulated housing between a first position, which is along the second direction, and a second position, which is along the first direction, and can move to a third position along the first direction.

The limiting unit includes a third element disposed on the insulated housing and a fourth element disposed on the cover body. When the cover body is on the first, second and third positions, it is positioned through mutual interference of the third and fourth elements, and depresses the contacts of the electronic card against the contact portions of the conductive terminals to produce an electrical connection subsequent to a frictioning action.

BRIEF DESCRIPTION OF THE DRAWINGS

The organization and manner of the structure and operation of the invention, together with further objects and advantages thereof, may best be understood by reference to the following description, taken in connection with the accompanying drawings, wherein like reference numerals identify like elements in which.

DETAILED DESCRIPTION OF THE DISCLOSED EMBODIMENT

Figure 1:
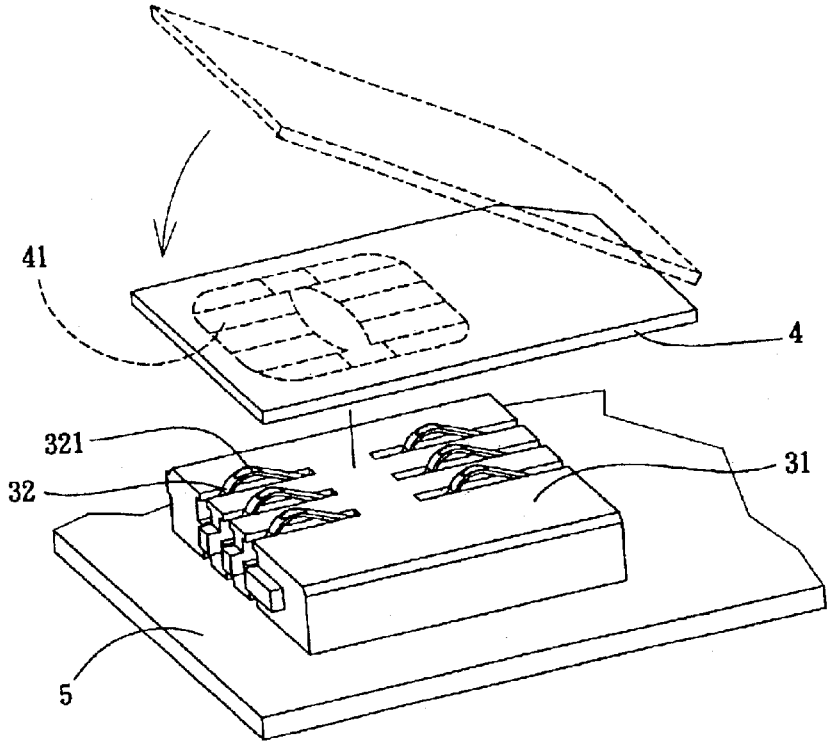
FIG. 1 is a perspective view of a conventional electrical connector in connection with an electronic card.
Figure 2:
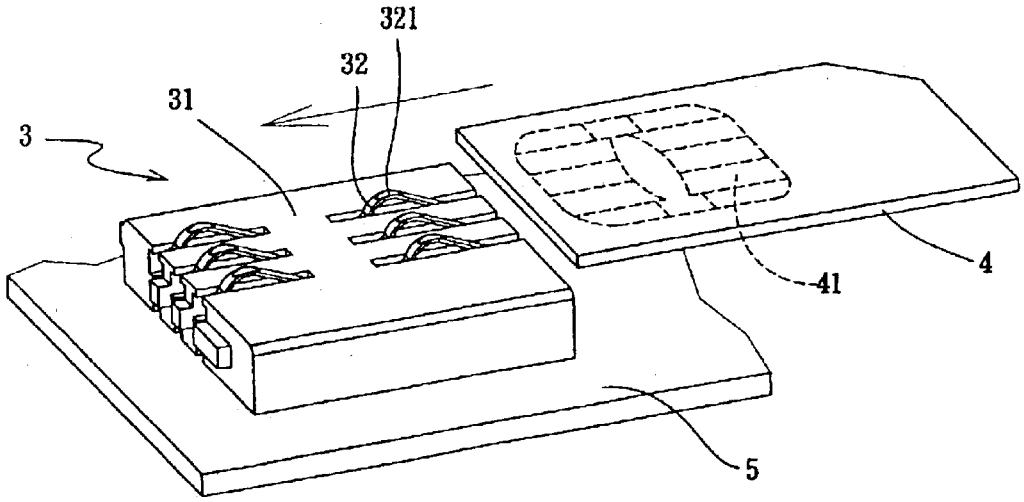
PRIOR ART FIG. 2
FIG. 2 is a perspective view of another conventional electrical connector in connection with the electronic card.

While the invention may be susceptible to embodiment in different forms, there is shown in the drawings, and herein will be described in detail, a specific embodiment with the understanding that the present disclosure is to be considered an exemplification of the principles of the invention, and is not intended to limit the invention to that as illustrated and described herein.

Referring to FIGS. 3 to 7, the disclosed embodiment of an electrical connector 1 according to the present invention is shown to comprise an insulated housing 11, a plurality of conductive terminals 12, and a cover body 15. The electrical connector 1 can be electrically connected to a circuit board (not shown) and an electronic card 2. The electronic card 2 has a side surface formed with a plurality of electrical contacts 21.

The insulated housing 11 has a front end 1101 and a rear end 1102. A first direction 1103 is defined by a phantom line that extends through the front and rear ends 1101, 1102. The insulated housing 11 includes a contact surface 113 for contact with the electronic card 2, a connecting surface 114 for connection with the circuit board, opposite first and second lateral surfaces 111, 112, a front end surface 115, and a rear end surface 116. The insulated housing 11 further includes six terminal passages 117, three of which extend rearwardly from the front end surface 115 through the contact surface 113 and the connecting surface 114 and the other three of which extend frontwardly from the rear end surface 116 through the contact surface 113 and the connecting surface 114.

Each of the conductive terminals 12 has an upright retaining portion 123, a contact portion 121 that extends horizontally from one end of the retaining portion 123 to a distance and then bends upwardly and frontwardly, and a connecting portion 122 that extends downwardly and inclinedly from the other end of the retaining portion 123. The retaining portion 123 has two sides provided with more than one barb 1231. Each conductive terminal 12 is disposed in a respective one of the terminal passages 117 in the insulated housing 11 and retained therein by interferentially engaging the barbs 1231 with the wall surface of the passage 117. The contact portion 121 of each conductive terminal 12 protrudes out of the contact surface 113 of the insulated housing 11, while the connecting portion 122 protrudes out of the connecting surface 114 of the insulated housing 11, and connects electrically with the circuit board.

Since the contact portions 121 of the conductive terminals 12 are in contact with respective electrical contacts 21 of the electronic card 2, and since the connecting portions 122 of the conductive terminal 12 are welded to the circuit board, opposite upper and lower forces are exerted on the retaining portions 123 of the conductive terminals 12. The retaining portions 123 are, therefore, likely to bend and protrude outwardly. However, because the barbs 1231 on the two sides of each conductive terminal 12 engage the wall surface of the corresponding terminal passage 117, the retaining portion 123 is restricted from projecting outward.

The cover body 15 is made of a metal, and includes a top wall 153 and two opposite first and second side walls 151, 152. The cover body 15 is pivotally mounted on the insulated housing 11 by means of a retaining unit. The retaining unit is composed of a first element provided on the insulated housing 11 and a second element provided on the cover body 15. The combination of the first and second elements provides two freely moving positions so as to permit the cover body 15 to pivot and move relative to the insulated housing 11. In this embodiment, the first element includes two guide holes 1111, 1121. Since the two guide holes 1111, 1121 have the same construction, only one guide hole 1111 will be described hereinafter. The guide hole 1111 is formed on the first lateral surface 111 of the insulated housing 11, and has a definite length that extends along the first direction 1103, a first end portion 1112 proximate to the front end 1101 of the insulated housing 11, and a second end portion 1113 proximate to the rear end 1102 of the insulated housing 11. The guide hole 1121 is formed correspondingly on the second lateral surface 112 of the insulated housing 11. The second element includes projecting spindles 1511, 1521 that protrude inwardly and respectively from the first and second side walls 151, 152 of the cover body 15.

When the cover body 15 and the insulated housing 11 are assembled, the top wall 153 abuts against the contact surface 113, the first and second side walls 151, 152 are adjacent respectively to the first and second lateral surfaces 111, 112, and the projecting spindles 1511, 1521 are received respectively in the guide holes 1111, 1112 so that the cover body 15 can rotate relative to the insulated housing 11. And, because the projecting spindle 1511 can move between the first and second end portions 11112, 1113 of the guide hole 1111 (the projecting spindle 1521 and the guide hole 1121 have the same relationship), the cover body 15 can move relative to the insulated housing 11 along the first direction 1103. As such, the cover body 15 is movable to a first position shown in FIG. 5, to a second position shown in FIG. 6, and to a third position shown in FIG. 7.

Figure 3:
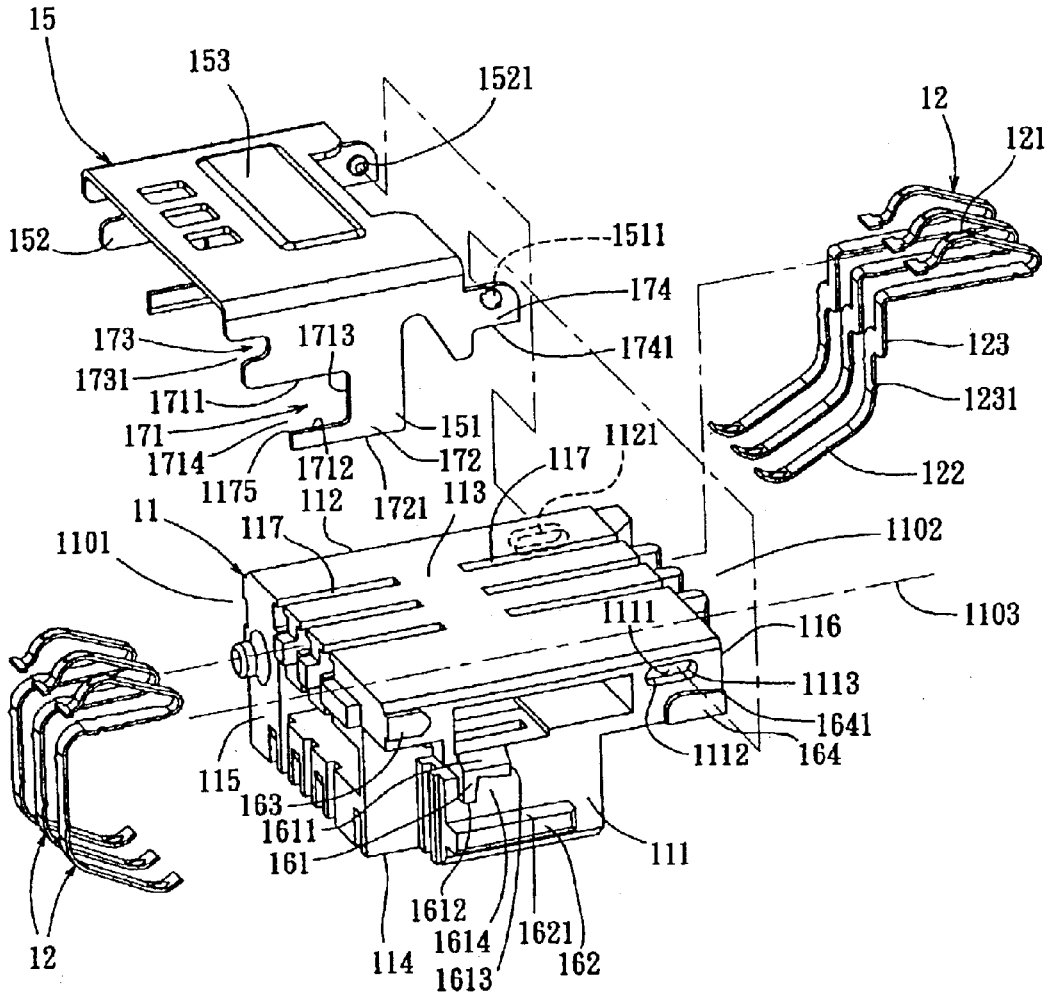
FIG. 3 is an exploded perspective of the disclosed embodiment of an electrical connector according to the present invention.
Figure 4:
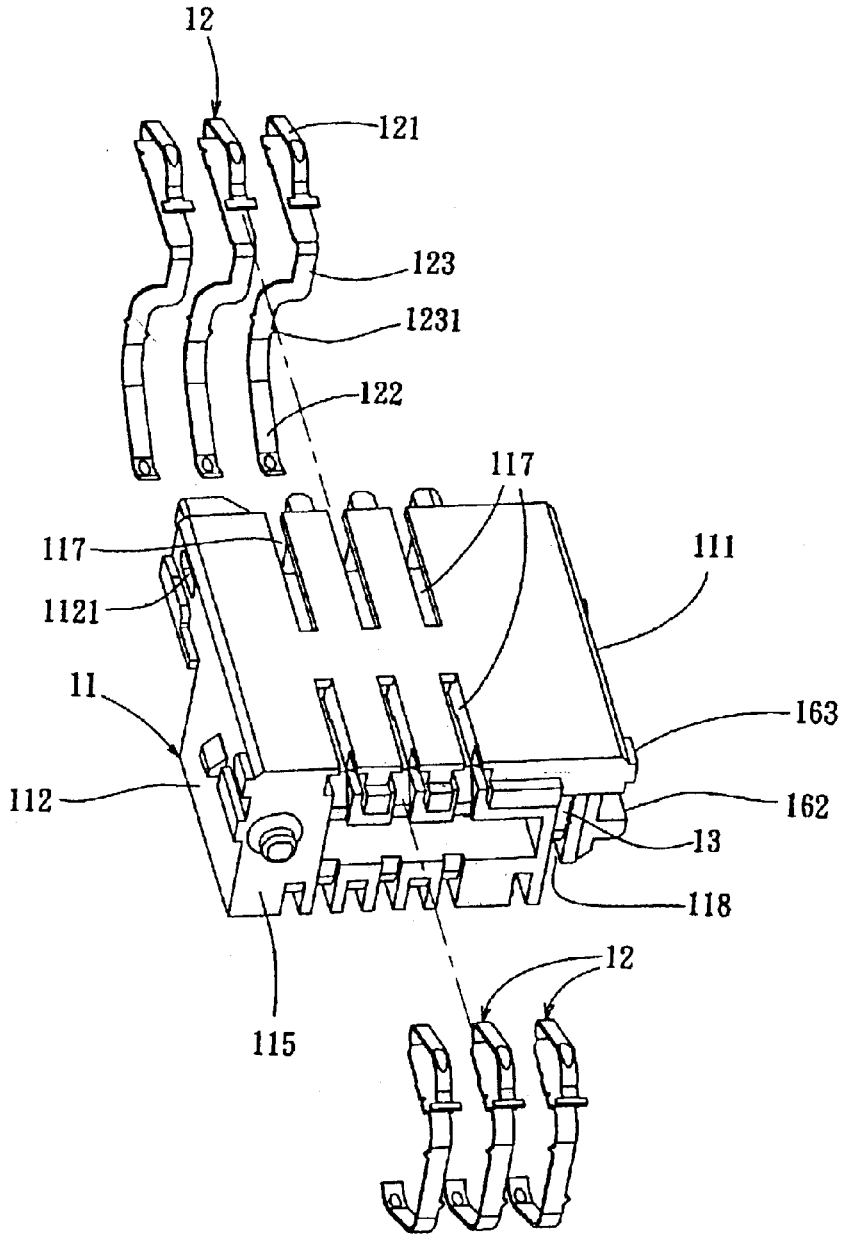
FIG. 4 is a partly exploded perspective of the disclosed embodiment, illustrating how the conductive terminals are assembled in an insulated housing.
Figure 5:
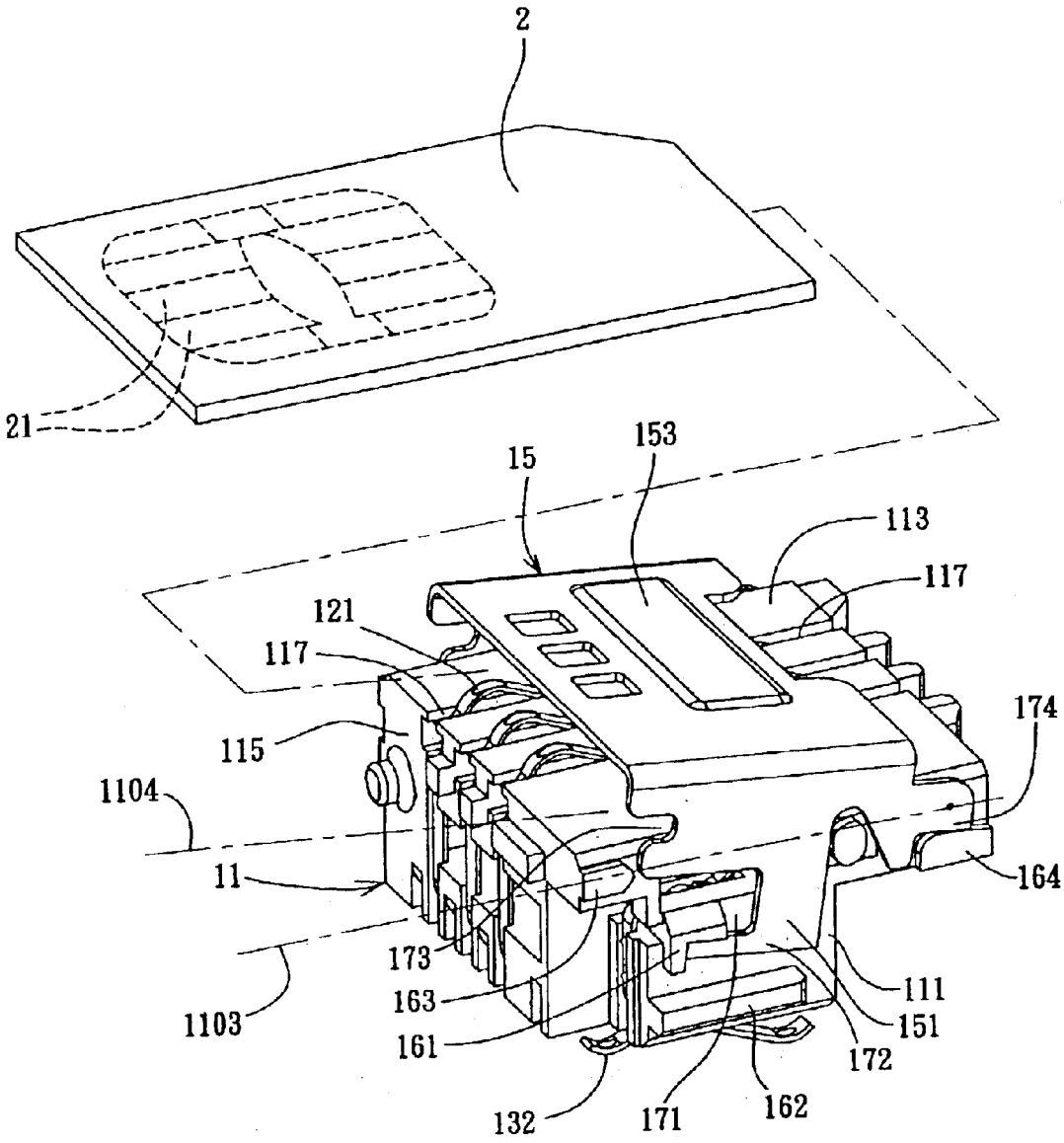
FIG. 5 is a perspective view of the assembly of the disclosed embodiment, wherein the cover body is at a first position.
Figure 6:
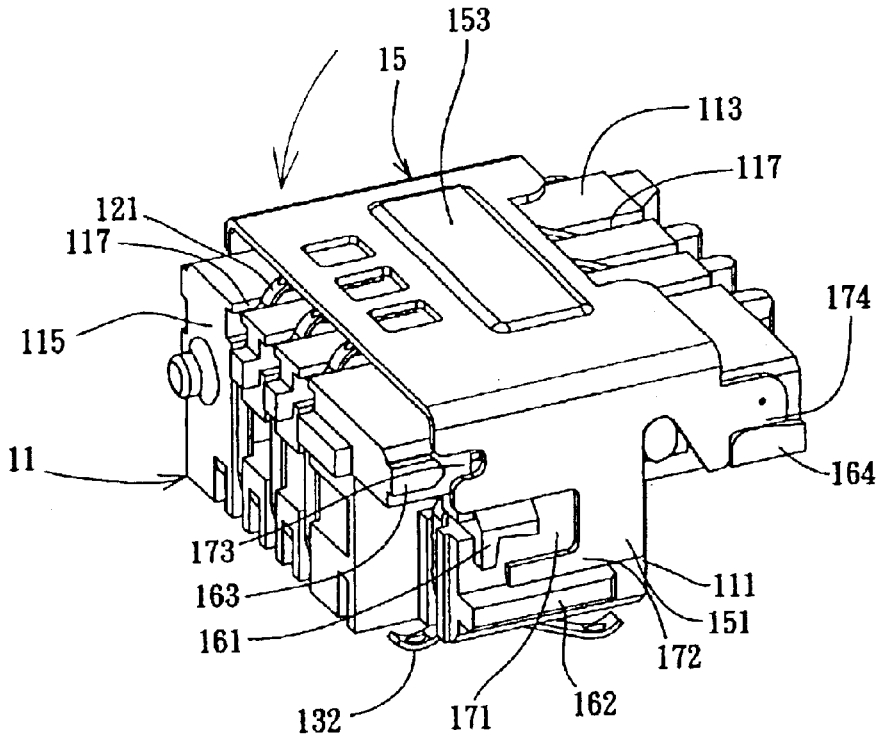
FIG. 6 is another perspective view of the disclosed embodiment, wherein the cover body is at a second position.
Figure 7:
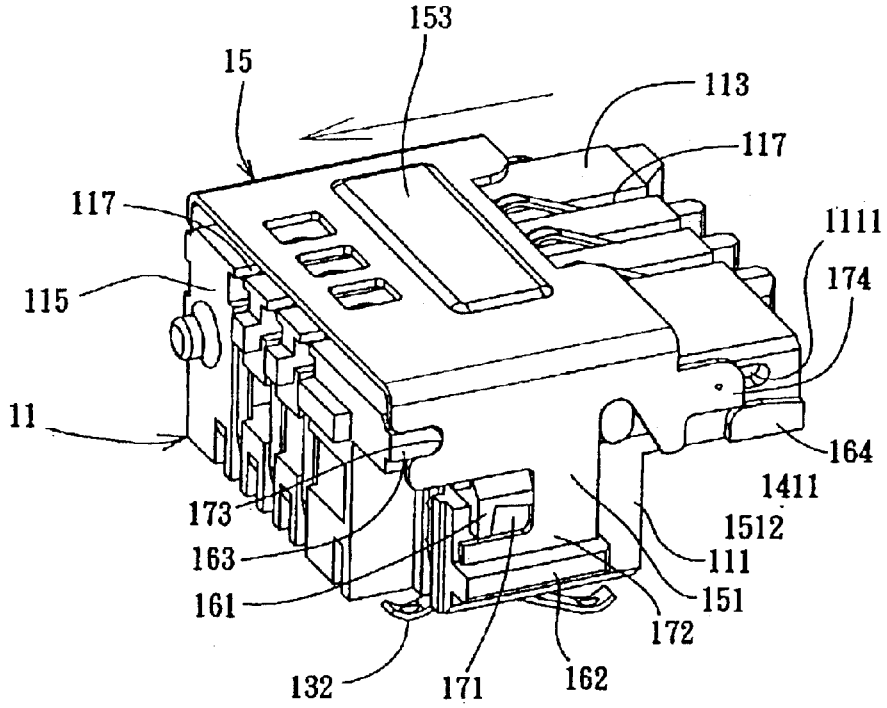
FIG. 7 is yet another perspective view of the disclosed embodiment, wherein the cover body is at a third position.

Referring to FIGS. 3 and 5, when the cover body 15 is in the first position, the projecting spindle 1511 is in the second end portion 1113 of the guide hole 1111 (since operational relationship between the projecting spindle 1521 and the projecting spindle 1511 is substantially the same, only the projecting spindle 1511 will be described hereinafter). The cover body 15 rotates about the projecting spindle 1511 until it is separated from the contact surface 113 of the insulated housing 11 so that the top wall 153 of the cover body 15 is inclined and defines a receiving space with the contact surface 113 of the insulated housing 11. The direction of the top wall 153 is defined as a second direction 1104, which forms an angle with the first direction 1103. A user can insert the electronic card 2, which has a SIM chip of a mobile phone, into the receiving space. After the electronic card 2 is inserted into the receiving space, the cover body 15 is rotated again about the projecting spindle 1511 to move toward the top surface of the insulated housing 11 and to press the electronic card 2 against the contact surface 113 of the insulated housing 11. The cover body 15 is now moved to the second position shown in FIG. 6. The electrical contacts 21 of the electronic card 2 are pressed against the contact portions 121 of the conductive terminals 12 at this time. Afterwards, the user can move the cover body 15 toward the front end 1101 of the insulated housing 11. As a result, the projecting spindle 1511 of the cover body 15 is moved from the second end portion 1113 to the first end portion 1112 of the guide hole 1111 along the first direction 1103 so that the cover body 15 can move from the second position to the third position (see FIG. 7). The electronic card 2 is moved simultaneously with the cover body 15. Such an operation produces relative movement between the electrical contacts 21 of the electronic card 2 and the contact portions 121 of the conductive terminals 12 within a short distance so that the electrical contacts 21 and the contact portions 121 wipe against each other to remove dust or contaminants, thus increasing the reliability of their electrical connection. Accordingly, the present invention not only solves the poor electrical contact problem encountered in the conventional electrical connector due to the point-to-point contact, but also eliminates the problem of wearing of the contact points due to the long frictioning distance occurring in another conventional connector. The electrical connector of the present invention can provide better electrical contacts and can prolong its service life. When removal of the electronic card 2 is desired, the cover body 15 is simply pushed backward from the third position to the second position, after which the cover body 15 is lifted to the first position.

Since the cover body 15 changes in position between the first, second and third positions, at least one limiting unit is provided in order to retain the cover body 15 at one desired position. In this embodiment, the limiting unit includes a third element provided on the insulated housing 11, and a fourth element provided on the cover body 15. By interferentially engaging the third element with the fourth element, the cover body 15 can be retained at one desired position. The interference engagement between the third and fourth elements may be provided in various forms. Some examples are described below.

Referring to FIG. 3, the third element has an inverted-L shaped first positioning unit 161 provided on and projecting out from the center of the first lateral surface 111 of the insulated housing 11. The first positioning unit 161 includes a first side 1611 proximate to the contact surface 113 of the insulated housing 11, a second side 1612 proximate to the connecting surface 114 of the insulated housing 11, a third side 1613 proximate to the rear end 1102 of the insulated housing 11, and a cut-out portion 1614 adjacent to the second and third sides 1612, 1613. The fourth element is a first engaging portion 171 provided correspondingly on the first side wall 151 of the cover body 15. The first engaging portion 171 is a notch 1714 formed proximate to the front end 1101 of the insulated housing 11. The notch 1714 is defined by a first inner side 1711, which is proximate to the contact surface 113 of the insulated housing 11, a second inner side 1712, which is proximate to the connecting surface 114 of the insulated housing 11, and a third inner side 1713, which is proximate to the rear end 1102 of the insulated housing 11. The third inner side 1713 forms a corner engaging end 1715.

Referring back to FIG. 5, when the cover body 15 is at the first position, the corner engaging end 1715 of the first engaging portion 171 engages the cut-out portion 1614 of the first positioning unit 161 so as to restrict the cover body 15 from rotating away from the insulated housing 11, and at the same time, to prevent movement of the cover body 15 from the inclined position toward the front end 1101 of the insulated housing 11. Referring back to FIG. 6, when the cover body 15 is at the second position, the first inner side 1711 of the first engaging portion 171 abuts against the first side 1611 of the first positioning unit 161 and is thereby stopped. Therefore, the top wall 153 of the cover body 15 and the contact surface 113 of the insulated housing 11 are spaced apart from each other at a certain distance. When the cover body 15 is at the third position (see FIG. 7), the first inner side 1711, the second inner side 1712, and the third inner side 1713 of the first engaging portion 171 abut respectively against the first side 1611, the second side 1612, and the third side 1613 of the first positioning unit 161. In this situation, the cover body 15 can neither move further nor rotate toward the front end.

The third element can further include a second positioning unit 162 disposed on and projecting out of the first lateral surface 111 of the insulated housing 11 proximate to the connecting surface 114. The second positioning unit 162 has a blocking side 1621 proximate to the connecting surface 114 and extending along the first direction 1103. The fourth element further includes a second engaging portion 172 disposed correspondingly on the first side wall 151 of the cover body 15 away from an edge of the top wall 153. The second engaging portion 172 is formed with an abutting side 1721 that corresponds to the blocking side 1621 of the second positioning unit 162. When the cover body 15 rotates from the first position to the second position, the abutting side 1721 can abut against the blocking side 1621 so as to restrict movement of the cover body 15. Such operation can also strengthen the effect of the first engaging portion 171 and the first positioning unit 161. When the cover body 15 reaches the third position from the second position, because the blocking side 1621 extends in parallel to the first direction 1103, the blocking side 1621 can guide the abutting side 1721 to move along the first direction 1103.

The third element may further include a third positioning unit 163 disposed on and projecting out of the first lateral surface 111 of the insulated housing 11 proximate to the front end 1101, whereas the fourth element further includes a third engaging portion 173 formed as a recess disposed correspondingly on the first side wall 151 of the cover body 15 proximate to the front end 1101. The third engaging portion 173 is formed with an open end 1731 proximate to the front end 1101. When the cover body 15 reaches the third position from the second position, the open end 1731 can permit the third positioning unit 163 to extend into and engage fixedly the third engaging portion 173. This operation can further strengthen the effect of the first engaging portion 171 and the first positioning unit 161.

Moreover, the third element may further include a fourth positioning unit 164 disposed on and projecting out of the first lateral side 111 of the insulated housing 11 proximate to the rear end 1102. The fourth positioning unit 164 has a blocking side 1641 substantially parallel to, but slightly inclined downward relative to the first direction 1103. The fourth element further includes a fourth engaging portion 174 formed correspondingly under the projecting spindle 1511 of the cover body 15. The fourth engaging portion 174 has an abutting side 1741 parallel to the first direction 1103. When the cover body 15 rotates from the second position to the first position, the abutting side 1741 of the fourth engaging portion 174 moves along with the cover body 15 and contacts the blocking side 1641 of the fourth positioning unit 164. Since the blocking side 1641 is inclined downwardly, it can prevent over rotation of the cover body 15. Such operation can further strengthen the effect of the first engaging portion 171 and the first positioning unit 161.

In this embodiment, although the third and fourth elements are formed from a combination of a plurality of inter-engaging limiting units, not all of them need to operate simultaneously. The units can be selectively combined or used individually. It is obvious that similar limiting units can be provided on the second lateral surface 112 of the insulated housing 11 and the second side wall 152 of the cover body 15, and that variations can be made according to actual requirements.

As described above, the cover body 15 of the present invention can be moved by the user to the first position, the second position, and the third position relative to the insulated housing 11 so that the electrical contacts 21 of the electronic card 2 can be pressed to contact with the contact portions 121 of the conductive terminals 12 when the cover body 15 is pivoted from the first position to the second position. Moreover, when the cover body 15 is moved from the second position to the third position, the cover body 15 simultaneously moves the electronic card 2 such that the electrical contacts 21 of the electronic card 2 and the contact portions 121 of the conductive terminals 12 wipe against each other through a short distance relative movement to remove the dust or contaminants, thereby increasing reliability of the electrical contacts.

While a preferred embodiment of the present invention is shown and described, it is envisioned that those skilled in the art may devise various modifications of the present invention without departing from the spirit and scope of the appended claims.

What is claimed is:

1. An electrical connector for electrically connecting a circuit board to an electronic card having a plurality of electrical contacts, said electrical connector comprising:

an insulated housing having a contact surface for contact with the electronic card, a connecting surface for connection with the circuit board, and opposite first and second lateral surfaces, said insulated housing including a plurality of terminal passages disposed between said contact surface and said connecting surface, and defining a first direction and a second direction that forms an angle with said first direction;

a plurality of conductive terminals received respectively inside said passages, each conductive terminal having a contact portion projecting out of said contact surface, and an engaging portion projecting out of said connecting surface and connecting electrically said circuit board;

a cover body mounted movably and pivotally on said insulated housing, said cover body and said contact surface of said insulated housing cooperating to define a receiving space for insertion of said electronic card therein; and a retaining unit including a first element disposed on said insulated housing proximate a front end of said insulated housing and a second element disposed correspondingly on said cover body, said first element and said second element engaging movably, wherein, through said retaining unit, said cover body can pivot relative to said insulated housing between a first position, which is along said second direction, and a second position, which is along said first direction, and can move to a third position along said first direction said third position being nearer to the front end of said housing than said second position.

2. The electrical connector as claimed in claim 1, including at least one limiting unit including a third element disposed on said insulated housing and a fourth element disposed on said cover body, wherein, when said cover body is in said first, second and third positions, said cover body is positioned through interference between said third and fourth elements, and the electronic card is connected electrically to said contact portions of said conductive terminals.

3. The electrical connector as claimed in claim 2, wherein said cover body includes a top wall proximate to the contact surface of said insulated housing, a first side wall connected to said top wall and proximate to the first lateral surface of said insulated housing, and a second side wall connected to said top wall and proximate to the second lateral surface of said insulated housing, said insulated housing forming a first end and a rear end along said first direction.

4. The electrical connector as claimed in claim 3, wherein said first element of said retaining unit includes two guide holes formed respectively in first and second lateral surfaces of said insulated housing, each of said guide holes having opposite first and second end portion parallel to said first direction, the second element including two protruding spindles disposed respectively on first and second side walls of said cover body, said protruding spindles being received respectively in said guide holes such that said cover body, with said protruding spindles serving as a pivot center, is rotatable relative to said insulated housing, is movable between the first end portion and the second end portion of said guide holes, and is movable between said first position, said second position, and said third position.

5. The electrical connector as claimed in claim 3, wherein said third element of said limiting unit includes a first positioning unit protruding on the first lateral surface of said insulated housing, said first positioning unit including a first side proximate to said contact surface, a second side proximate to said connecting surface, a third side proximate to said rear end, and a cut-out portion adjacent to said second and third sides, said fourth element of said limiting unit including a first engaging portion disposed correspondingly on the first side wall of said cover body, said first engaging portion including a notch formed proximate to the front end of said insulated housing, said first engaging portion being formed with a first inner side proximate to the contact surface, a second inner side proximate to the connecting surface, and a third inner side proximate to the rear end and being formed as a corner engaging end, wherein, when said cover body is at said first position, said corner engaging end of said first engaging portion engages said cut-out portion so as to restrict said cover body from rotating away from said insulated housing, wherein, when said cover body is at said second position, the first inner side of said first engaging portion abuts against said first side of said first positioning unit and is thereby stopped, wherein, when said cover body is at said third position, the first inner side, the second inner side, and the third inner side of said first engaging portion abut respectively against the first side, the second side, and the third side of said first positioning unit and positioned thereon.

6. The electrical connector as claimed in claim 3, wherein said third element of said limiting unit includes a second positioning unit projecting out of the first lateral surface of said insulated housing, said second positioning unit having a blocking side proximate to said connecting surface and extending along said first direction, said fourth element of said limiting unit being a second engaging portion disposed on the first side wall of said cover body, said second engaging portion being formed with an abutting side that corresponds to said blocking side, wherein, when said cover body rotates from said first position to said second position, said abutting side abuts against the blocking side so as to limit movement of said cover body, said abutting side moving along said first direction relative to movement of said blocking side so that said cover body can reach said third position from said second position.

7. The electrical connector as claimed in claim 3, wherein said third element of said limiting unit is a third positioning unit projecting out of the first lateral surface of said insulated housing, said fourth element being a third engaging portion formed as a recess with an open end proximate to said front end of said insulated housing, wherein, when said cover body reaches said third position from said second position, said open end receives said third positioning unit so as to engage fixedly said third engaging portion.

8. The electrical connector as claimed in claim 3, wherein said third element of said limiting unit includes a fourth positioning unit projecting out of the first lateral side of said insulated housing, said fourth positioning unit having a blocking side, said fourth element being a fourth engaging portion disposed on the first side wall of said cover body, said fourth engaging portion having an abutting side, wherein, when said cover body rotates from said second position to said first position, said abutting side moves along with said cover body so as to abut against said blocking side such that movement of said top wall of said cover body toward said contact surface of said insulated housing is restricted.

9. The electrical connector as claimed in claim 2, wherein a retaining unit is provided between said contact portion and said connecting portion of each of said conductive terminals, said retaining unit having more than one barb for engaging the wall surface of a corresponding one of the passages.

* * * * *